US007104308B2

(12) United States Patent
Kubota

(10) Patent No.: US 7,104,308 B2
(45) Date of Patent: Sep. 12, 2006

(54) VACUUM CASTING DIE

(75) Inventor: Shoko Kubota, Kanagawa (JP)

(73) Assignee: Toshiba Kikai Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/846,915

(22) Filed: May 17, 2004

(65) Prior Publication Data

US 2004/0250979 A1 Dec. 16, 2004

(30) Foreign Application Priority Data

May 16, 2003 (JP) ..... 2003-138336

(51) Int. Cl.
*B22D 17/00* (2006.01)

(52) U.S. Cl. ..... 164/305; 164/312; 164/314; 164/340; 164/253

(58) Field of Classification Search ..... 164/305, 164/312, 113, 314, 65, 340, 253
See application file for complete search history.

(56) References Cited

U.S. PATENT DOCUMENTS 2,785,448 A 3/1957 Hodler ..... 164/305
4,240,497 A * 12/1980 Glazunov et al. ..... 164/158
6,808,008 B1 * 10/2004 Kubota ..... 164/305

FOREIGN PATENT DOCUMENTS

JP 407047457 * 2/1995
JP 2000288713 * 10/2000
JP 2002-239705 8/2002

* cited by examiner

*Primary Examiner*—Kevin Kerns
*Assistant Examiner*—I.-H. Lin
(74) *Attorney, Agent, or Firm*—Pillsbury Winthrop Shaw Pittman LLP

(57) ABSTRACT

A vacuum casting die simpler in configuration and improved in seal performance in vacuum casting using a slide core, provided with a pair of main dies, a sealing member for seamlessly and continuously sealing mating faces around the closed space formed between the main dies, and a slide core housed in the sealed space formed between the main dies sealed by the sealing member.

1 Claim, 6 Drawing Sheets

VACUUM CASTING DIE

BACKGROUND OF THE INVENTION

1. Field of Invention

The present invention is relates to a die used for vacuum casting.

2. Description of the Related Art

One of the reasons for variations in quality of die cast products and the resultant drop in reliability is gas contained in the die cast products. That is, molten metal injected and filled at a high speed and high pressure forms turbulence inside the injection sleeve and die cavity resulting in entrainment of air or vaporized release agent coated on the die.

To overcome this disadvantage, there is known the technology of casting using a die casting machine using the vacuum die casting method so as to suppress entrainment of gas in the die cast products and thereby reduce variations in quality due to the content of gas in the die cast products (for example, see U.S. Pat. No. 2,785,448).

In a die casting machine using the vacuum die casting method, the die cavity has to be able to be made greater in vacuum and the reduced pressure state maintained in order to cast a high strength and quality product. If the die cavity is not made high in vacuum, the cast product may contain gas. As a result, when applying annealing or other heat treatment to the product after casting, the product will easily suffer from distortion or deformation and it will be difficult to obtain a sufficient effect by the vacuum die casting method.

Japanese Unexamined Patent Publication (Kokai) No. 2002-239705 discloses technology for obtaining a better vacuum in the die cavity and maintaining the reduced pressure state by seamlessly and continuously sealing the mating faces around the cavity.

Summarizing the disadvantages to be solved by the invention, when a casting product has recesses or hollow parts which cannot be molded in the opening/closing direction of the die, it is necessary to insert a so-called slide core between the dies for casting. The slide core inserted between the dies before casting is pulled out in a direction along the mating faces of the dies after casting, then the casting product is taken out from the dies. When using a slide core for vacuum casting and moving the slide core, it is necessary to prevent the slide core from interfering with the seal member. Therefore, the seal structure around the slide core becomes complicated and the reliability of the seal performance easily falls.

SUMMARY OF THE INVENTION

An object of the present invention is to obtain a suitable reduced pressure and reliably prevent the entry of a molten metal into a valve when reducing the pressure in a cavity and injecting and filling it with the molten metal for casting.

To achieve this object, there is provided a vacuum casting die provided with a pair of main dies, a sealing means for seamlessly and continuously sealing mating faces around a closed space formed between the main dies, and a slide core included in the sealed space defined between the main dies sealed by the sealing means.

Preferably, the die is further provided with a driving means provided outside of the main dies and making the slide core slide, a connecting member for connecting the driving means and the slide core, a through hole formed in a main die and passed through by the connecting member, and a second sealing means for sealing between the through hole and the connecting member.

In the present invention, in the state with the mating faces of the pair of main dies sealed by the seal means, the slide core is included in the sealed space sealed by the sealing means. That is, the mating faces of the main dies are seamlessly and continuously sealed, so the seal performance is high.

BRIEF DESCRIPTION OF THE DRAWINGS

These and other objects and features of the present invention will become clearer from the following description of the preferred embodiments given with reference to the attached drawings, wherein.

DESCRIPTION OF THE PREFERRED EMBODIMENTS

Preferred embodiments of the present invention will be described in detail below while referring to the attached drawings.

Figure 1:
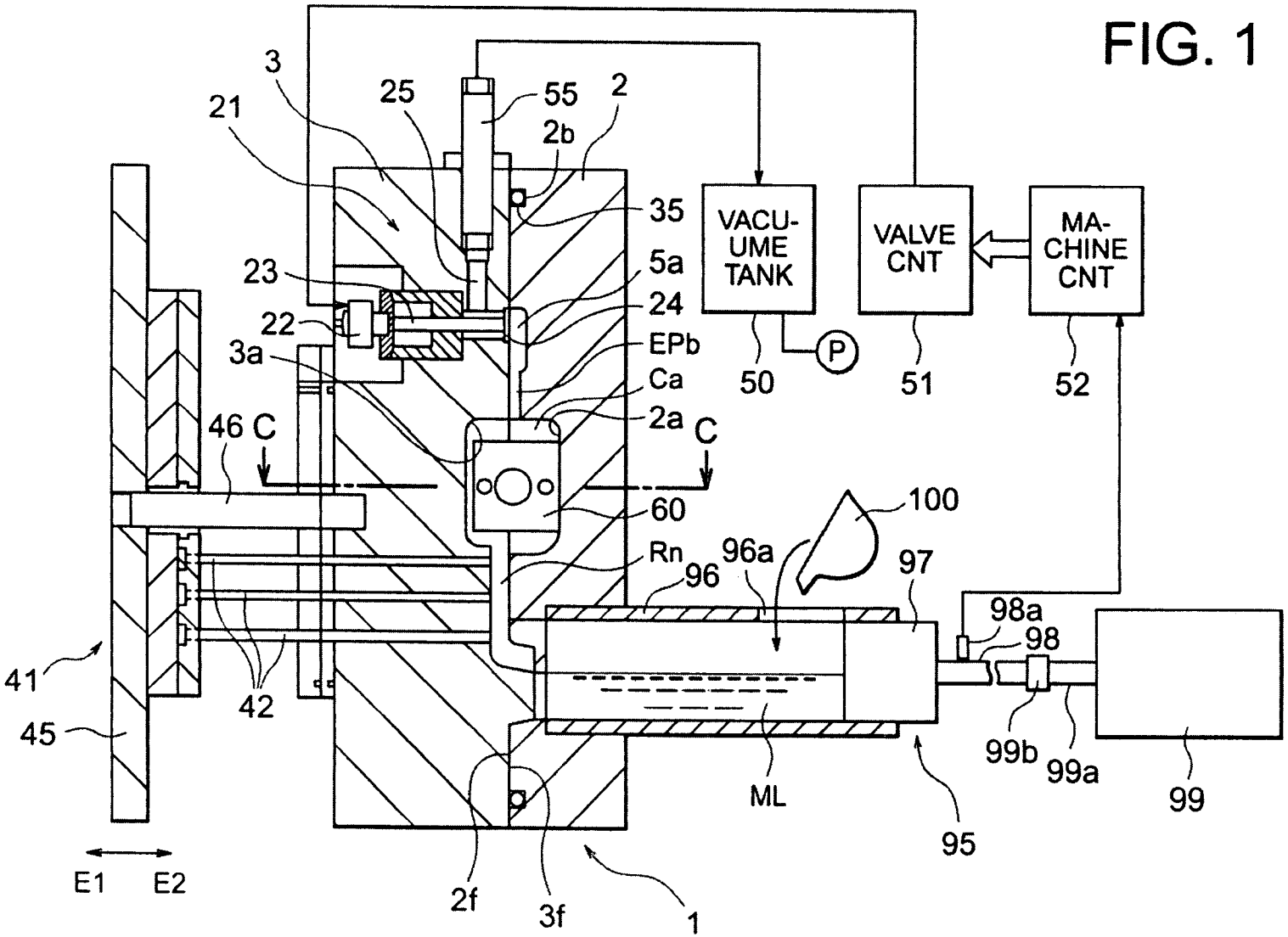
FIG. 1 is a cross-sectional view of the structure of a vacuum casting die according to a first embodiment of the present invention.
Figure 2:
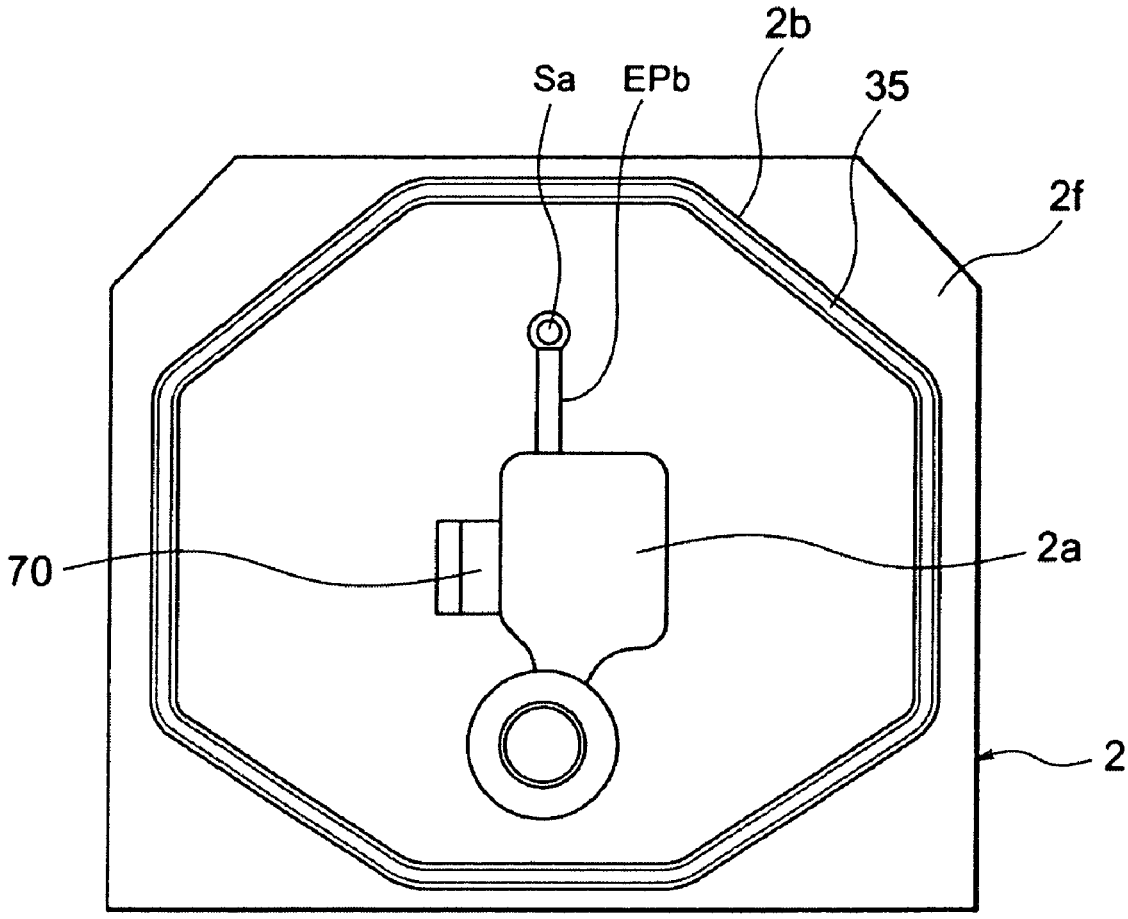
FIG. 2 is a view of the structure of the mating face of a fixed die.
Figure 3:
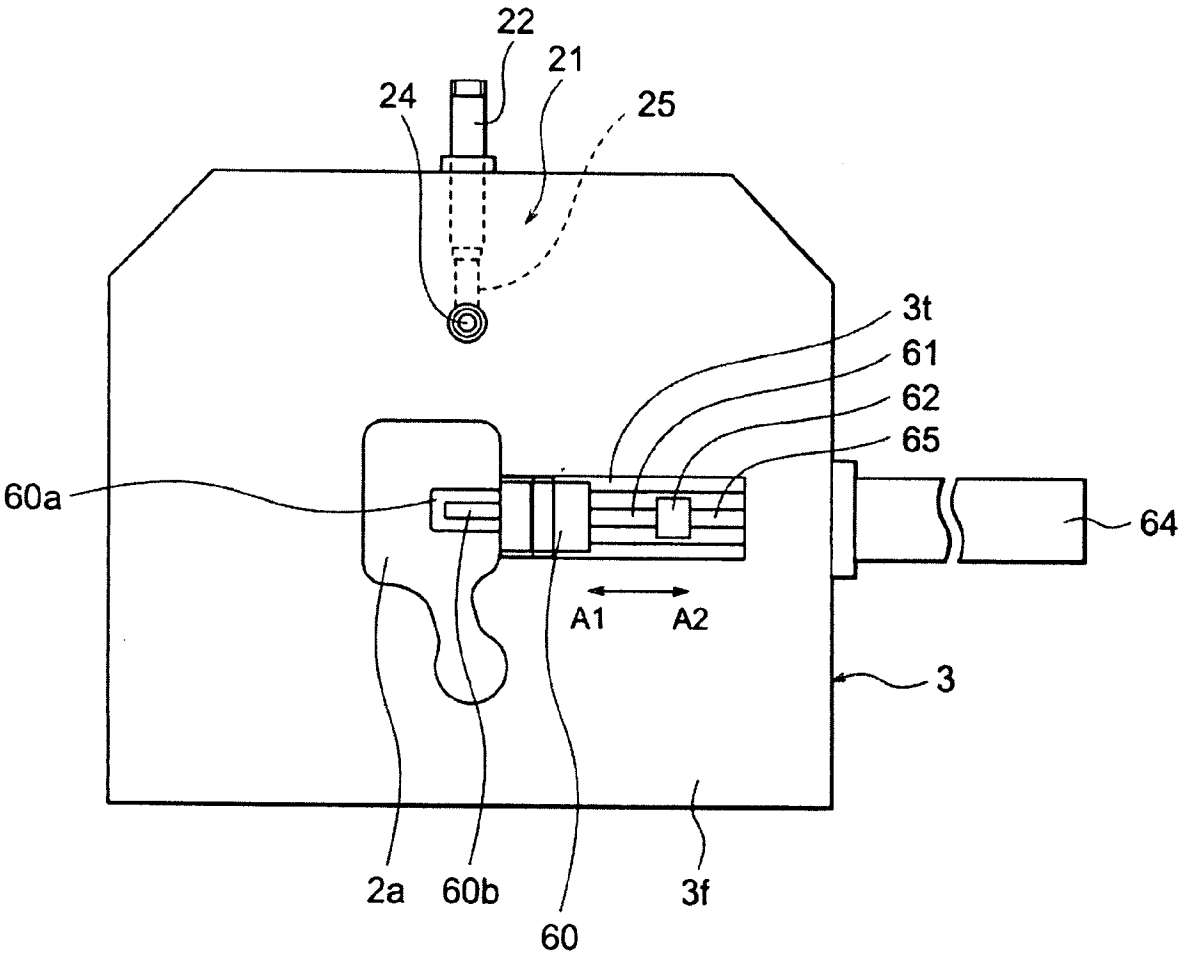
FIG. 3 is a view of the structure of the mating face of a movable die.
Figure 4:
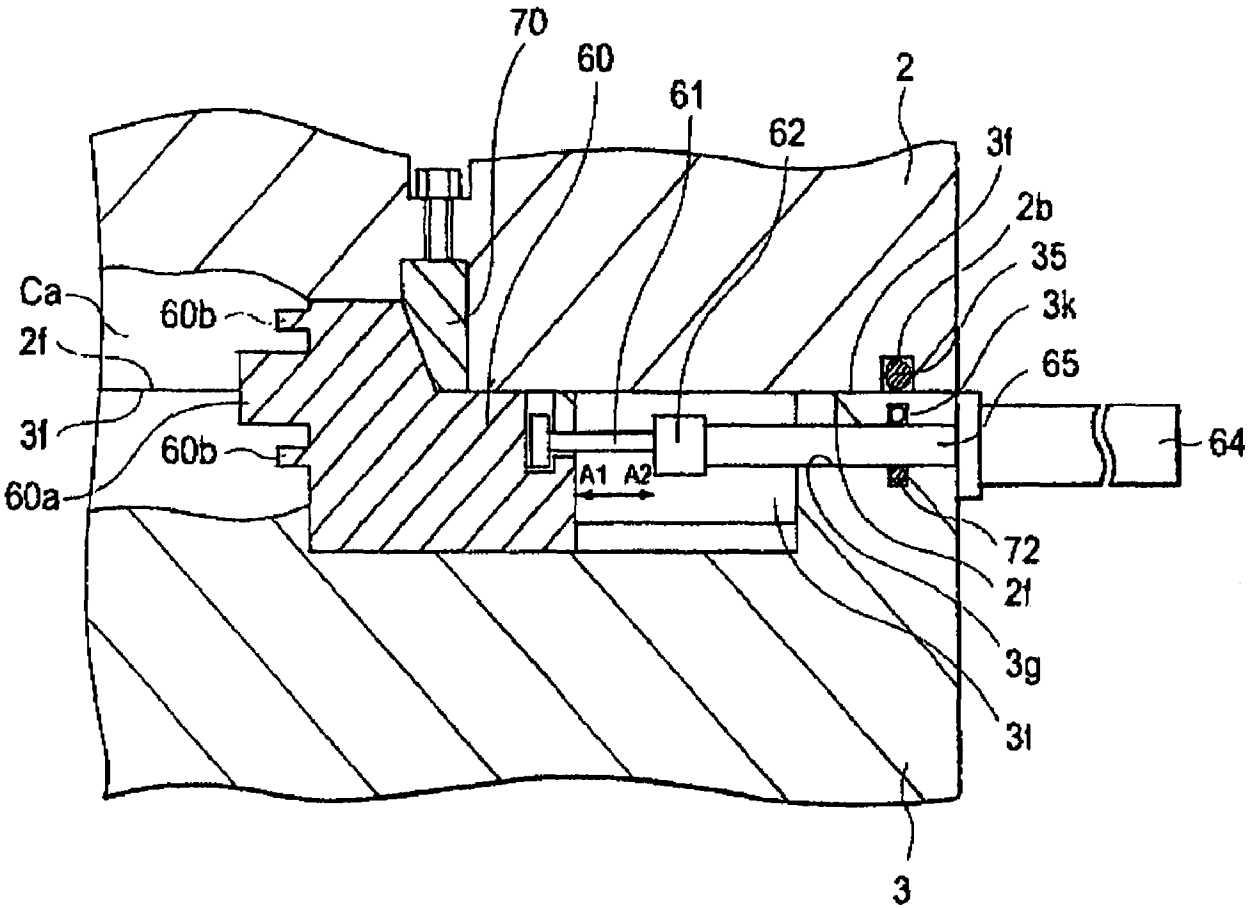
FIG. 4 is an enlarged cross-sectional view in the horizontal direction of the area around the slide core.

FIG. 1 is a cross-sectional view of the structure of a vacuum casting die according to an embodiment of the present invention. FIG. 2 is a view of the structure of the mating face of a fixed die, FIG. 3 is a view of the structure of the mating face of a movable die, and FIG. 4 is an enlarged cross-sectional view along the direction of the C—C line of FIG. 1 of the area around the slide core.

As shown in FIG. 1, the vacuum casting die 1 according to the present embodiment has a fixed die 2 and a movable die 3 corresponding to the pair of dies of the claims of the present invention.

The fixed die 2 is fixed to a fixed die plate of a not shown mold clamping apparatus. The movable die 3 is fixed to a not illustrated movable die plate provided movably with respect to the fixed die plate. When the mating face 3*f* of the movable die 3 contacts the mating face 2*f* of the fixed die 2 to close the dies, a cavity Ca is defined by the recess 2*a* of the fixed die 2 and the recess 3*a* of the movable die 3.

At the back side of the movable die 2 is provided an eject mechanism 41. This eject mechanism 41 is provided with a plurality of eject pins 42, a movable plate 45 for holding first ends of the eject pins 42, and a guide shaft 46 for movably guiding the movable plate 45 with respect to the movable die 3.

The movable plate 45 is guided movably in the direction of the arrows E1 and E2. This movable plate 45 is moved by a not shown drive means in a predetermined range in the directions of the arrows E1 and E2. By moving the movable plate 45 in the direction of the arrow E2, the front ends of the eject pins stick out from the mating face 3*f* of the movable die 3*f* and push out the casting product.

At the back side of the fixed die 2 is provided an injection apparatus 95. The injection apparatus 95 is provided with a cylindrical sleeve 96, a plunger tip 97 fitting into the sleeve 96, a plunger rod 98 with one end linked with the plunger tip 97, and a cylinder 99 with the other end linked with the plunger rod 98.

The sleeve 96 is provided with a feed port 96*a*. Molten metal ML is fed into the sleeve 96 from the feed port 96*a* by a ladle 100. The cylinder 99 includes a piston. The piston rod 99*a* linked with the piston and the plunger rod 98 are linked by a coupling 99*b*. This cylinder 99 is driven by oil pressure and extends and retracts the piston rod 99*a*.

The plunger 97 is linked with the plunger rod 98 and is moved in the sleeve 96 by being driven by the cylinder 99. By the plunger tip 97 moving to the fixed die 2 side inside the sleeve 96 fed with the molten metal ML, the molten metal ML is filled in the cavity Ca defined between the fixed die 2 and movable die 3 through a runner Rn communicated with the cavity Ca. The outer circumference of the plunger rod 98 is formed with magnetic poles N, S at a constant pitch in the axial direction. A sensor 98*a* detects the number of times the magnetic poles are passed as a series of pulses so as to measure the position and speed of the plunger tip 97. The detection signal of the sensor 98*a* is input to a machine controller 52. The machine controller 52 controls the drive of the injection apparatus 95 based on the position and speed of the plunger tip 97 detected.

As shown in FIG. 1, the movable die 3 is formed with an exhaust path 25. This exhaust path 25 is connected to an exhaust pipe 55. The exhaust pipe 55 is connected to a vacuum pump 50. The exhaust path 25 is communicated with the cavity Ca. The vacuum pump 50 exhausts it to reduce the pressure inside the cavity Ca.

As shown in FIG. 1, the movable die 3 is provided integrally with a valve mechanism 21. This valve mechanism 21 is provided with an electromagnetic actuator 22, a valve shaft 23 linked with an electromagnetic actuator 22, and a valve 24 integrally formed with an end of the valve shaft 23.

The electromagnetic actuator 22 is driven by a valve controller 51. Due to the drive operation by the electromagnetic actuator 22, when the valve 24 moves to the fixed die 2 side, the exhaust path 25 is opened. When the valve 24 moves to the movable die 3 side and contacts against the valve seat face, the exhaust path 25 is closed. The valve controller 51 drives the electromagnetic actuator 22 in accordance with an instruction from the machine controller 52. The machine controller 52 comprehensively controls the injection apparatus 94, not shown mold clamping apparatus and molten metal feed apparatus, etc.

As shown in FIG. 2, the mating face 2*a* of the fixed die 2 is formed with a groove 2*b* for fitting the seal member 35. This groove 3*b* has the seal member 35 fit inside it. When the mating face 3*a* of the movable die 3 and the mating face 2*a* of the movable die 2 are mated, the mating face 3*a* of the movable die 3 contacts the seal member 35 and the mating face 2*a* and mating face 3*a* are sealed. The seal member 35 corresponds to the sealing means of the claims of the present invention. The seal member 35 and groove 3*b* surround the cavity Ca. Further, the seal member 35 and groove 3*b* are formed seamlessly and continuously. The seal member 35 seals the cavity Ca tightly.

As shown in FIG. 2, the mating face 2*a* of the fixed die 2 is formed with a groove Epb for forming an exhaust path together with the mating face 3*f* of the movable die 3 and a recess Sa for securing the movable range of the valve 24. The cavity Ca and the exhaust path 25 are communicated through the groove Epb and the recess Sa.

Further, as shown in FIG. 2, the mating face 2*a* of the fixed die 2 is provided with a reinforcing member 70. This reinforcing member 70 is provided for the purpose of supporting the casting pressure acting on the later explained slide core and protecting the fixed die 2.

As shown in FIG. 3, the movable die 3 is provided with the slide core 60 in a slidable manner. The slide core 60 is provided slidably along the guide groove 3*t* formed in the horizontal direction along the mating face 3*f* of the movable die 3. The guide groove 3*t* is formed exactly a necessary distance in the slider of the slide core 60. As shown in FIG. 4, the front end of the slide core 60 is formed with a plurality of projections 60*a* and 60*b* for forming hollow parts or recesses in the casting product cast at the cavity Ca.

As shown in FIG. 4, the rear end of the slide core 60 at the opposite side to the projections 60*a* and 60*b* is connected to a connecting rod 61. This connecting rod 61 is connected to the piston rod 65 of the cylinder 64 through the coupling 62. The piston rod 65 corresponds to the connecting member of the claims of the present invention. The cylinder 64 is formed at one side 3*k* of the movable die 3. The piston rod 65 extends from and retracts in the push-in direction A1 and pull-out direction A2 shown in FIG. 4 by the feed of pressurized oil to the cylinder 64. The piston rod 65 is inserted into the through hole 3*g* formed in the movable die 3. The through hole 3*g* is formed with a groove 3*k* in its middle. The groove 3*k* has a seal member 72 fit into it. The seal member 72 corresponds to the sealing means of the claims of the present invention. The seal member 72 seals between the through hole 3*g* and piston rod 65. In the state with the fixed die 2 and the movable die 3 closed, the slide core 60 is constrained at a predetermined position by contact with a reinforcing member 70 and cannot move in the push-in direction Al and pull-out direction A2.

An example of vacuum casting using a vacuum casting die 1 of the above configuration will be explained.

As shown in FIG. 1, the movable die 3 and the fixed die 2 are clamped, then a predetermined amount of molten metal ML is fed by the ladle 100 to the sleeve 96 of the injection apparatus 95. In this state, the pressure P inside the cavity Ca shown in FIG. 1 is equal to the ambient pressure. The vacuum pump 50 is started up to enable exhaust. Further, the valve 24 is used to close the exhaust path 25.

After the molten metal ML finishes being fed into the sleeve 96 by the ladle 100, the plunger tip 97 is advanced at a low speed. When the plunger tip 97 is advanced, the feed port 96*a* of the sleeve 96 is blocked by the plunger tip 97. When the plunger tip 97 blocks the feed port 96*a*, the cavity Ca is sealed and shut off from the outside. Further, the slide core 60 is inserted into this sealed space.

In this state, the valve 24 is opened and the cavity Ca starts to be exhausted. Along with the start of the start of exhaust, the slowly advancing plunger tip 97 moves to a predetermined position, whereupon the valve 24 is closed and the exhaust path 25 is blocked. When the plunger tip 97 reaches this predetermined position, the cavity Ca is reduced to the desired pressure. By closing the valve 24, the reduced pressure state in the cavity Ca is maintained.

Figure 5:
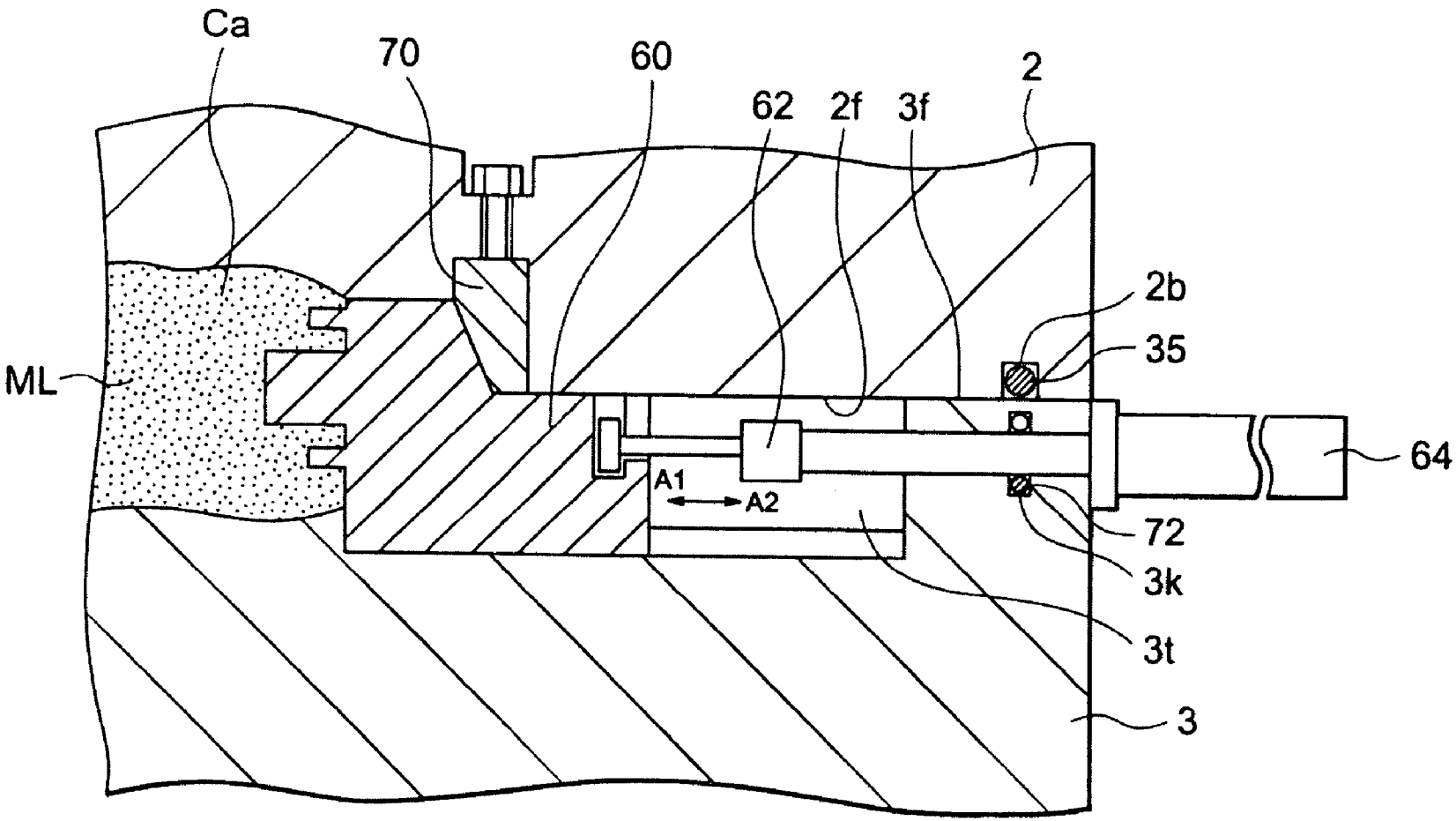
FIG. 5 is an enlarged cross-sectional view in the horizontal direction of the area around the slide core when molten metal is filled in the cavity.

When the plunger tip 97 reaches the predetermined speed switching position, the speed of the plunger tip 97 is switched to high speed. Due to this, as shown in FIG. 5, the reduced pressure cavity Ca is injected and filled with molten metal ML.

After the reduced pressure cavity Ca is filled with the molten metal ML, when the plunger tip 97 reaches a predetermined position, speed control is switched to pressure control and the casting pressure is raised to a predetermined magnitude. When the pressure rising step is completed, the casting product finishes being formed.

Figure 6:
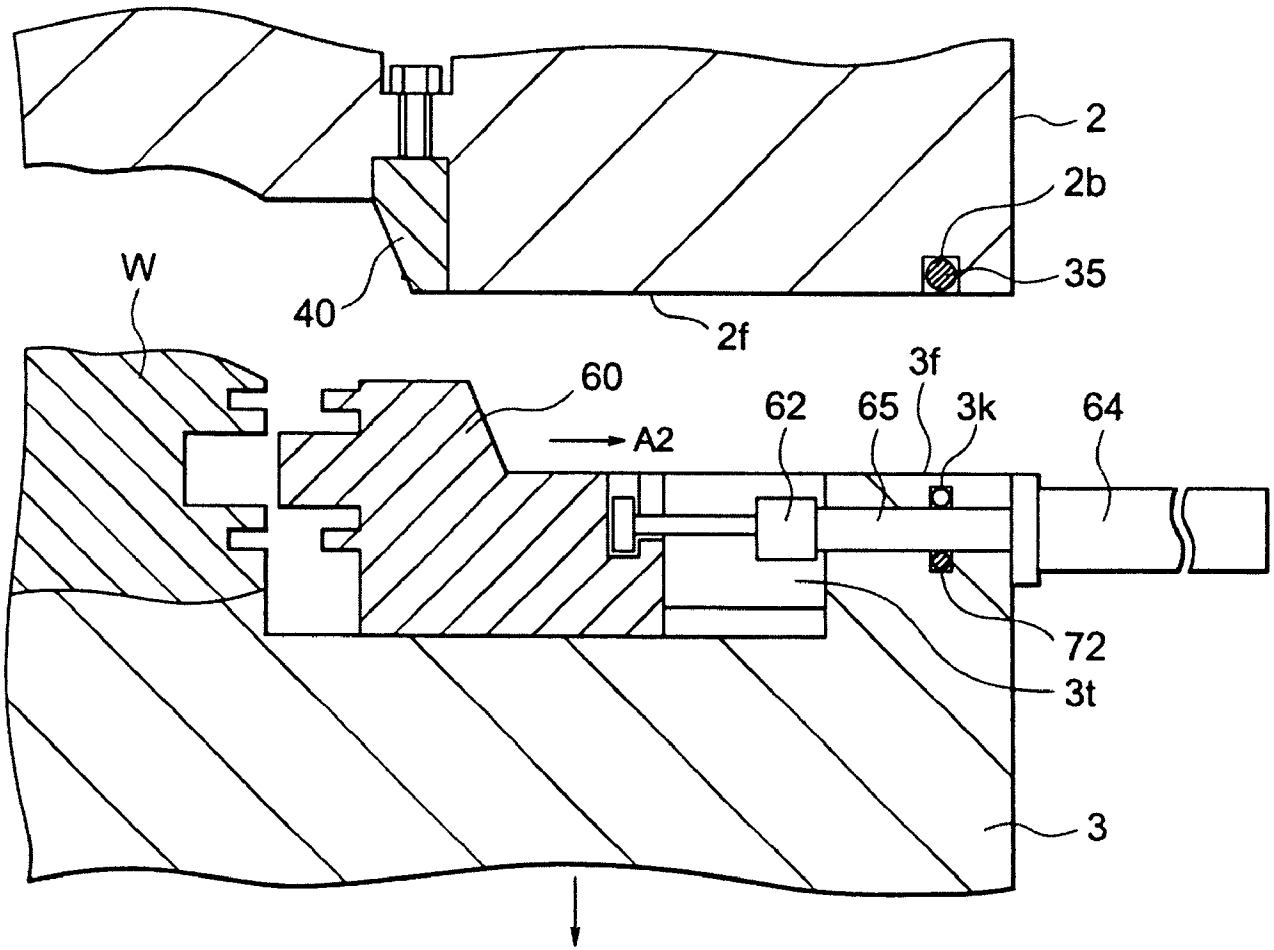
FIG. 6 is an enlarged cross-sectional view in the horizontal direction of the area around the slide core showing the state after FIG. 5.

Then, the valve 24 is opened, then, as shown in FIG. 6, the movable die 3 is clamped. Due to this, the constraint on the slide core 60 is released. If driving the cylinder 64 and moving the slide core 60 in the pull-out direction A2, the projections 60*a* and 60*b* of the slide core 60 are pulled out from the casting product W. The casting product W held in the movable die 3 is pushed out of the movable die 3 by the eject pins 42.

According to the present embodiment, in the state with the mating face 2*f* of the fixed die 2 mated with the mating face 3*f* of the movable die 3, the slide core 60 is included in the sealed space sealed by the seal member 35. The seal member 35 seals between the flat mating face 2*f* and mating face 3*f*. Since it seamlessly and continuously seals it, the seal performance is extremely high. Accordingly, the inside of the cavity Ca can be made high in vacuum and the reduced pressure state can be reliably maintained.

According to the present embodiment, just the necessary groove 3*t* is formed at the slider of the slide core 60 at the mating face 3*f* of the movable die 3. No unnecessary space is formed between the mating face 2*f* of the fixed die 2 and the mating face 3*f* of the movable die 3. Therefore, when exhausting the cavity Ca after clamping, the time required for exhaust does not become longer and the cavity can be exhausted and reduced to the desired pressure quickly.

The present invention is not limited to the above embodiment. In the above embodiment, a configuration using a slider to make the slide core 60 slide was explained, but in the case of a die making the slide core linked with the die opening/closing operation using an inclined pin, it is sufficient to contain the inclined pin in the space sealed by the seal member 35.

Summarizing the effects of the invention, according to the present invention, it is possible to obtain a vacuum casting die simpler in configuration and using a slide core improved in seal performance.

While the invention has been described with reference to specific embodiments chosen for purpose of illustration, it should be apparent that numerous modifications could be made thereto by those skilled in the art without departing from the basic concept and scope of the invention.

I claim:

1. A vacuum casting die comprising:

a pair of main dies, a sealing means for seamlessly and continuously sealing mating faces around a closed space formed between said main dies, a slide core included in the sealed space formed between said main dies sealed by said sealing means, a driving means provided outside of said main dies and making said slide core slide, a connecting member for connecting said driving means and said slide core, a through hole formed in one of the main dies and passed through by said connecting member, and a second sealing means for sealing between said through hole and said connecting member.

* * * * *